US005879092A

United States Patent [19]

Brannan et al.

[11] Patent Number: 5,879,092

[45] Date of Patent: Mar. 9, 1999

[54] PAPER FEED FAULT DETECTION SYSTEM FOR AUTOMATED BANKING MACHINE

[75] Inventors: Jeffrey A. Brannan, Massillon; Kim R. Lewis, Stow; Kenneth J. Schanz, Richmond Heights, all of Ohio

[73] Assignee: InterBold, North Canton, Ohio

[21] Appl. No.: 15,142

[22] Filed: Jan. 29, 1998

Related U.S. Application Data

[63] Continuation of PCT/US96/17818, Nov. 7, 1996, which is a continuation-in-part of Ser. No. 568,887, Dec. 7, 1995, Pat. No. 5,725,321.

[51] Int. Cl.[6] ..... B41J 11/00

[52] U.S. Cl. ..... 400/708; 400/611; 400/618

[58] Field of Search ..... 400/708, 611, 400/618; 242/534, 563; 226/108, 45

[56] References Cited

U.S. PATENT DOCUMENTS

| | | | |
|---|---|---|---|
| 4,469,291 | 9/1984 | Treiber et al. | 242/412.2 |
| 4,903,100 | 2/1990 | Kogane et al. | 355/27 |
| 4,909,426 | 3/1990 | Crowley et al. | 226/108 |
| 4,953,805 | 9/1990 | Rauh | 242/559.1 |
| 4,967,222 | 10/1990 | Nitsch | 396/616 |
| 5,725,321 | 3/1998 | Brannan et al. | 400/708 |

*Primary Examiner*—Edgar Burr
*Assistant Examiner*—Daniel J. Colilla
*Attorney, Agent, or Firm*—Ralph E. Jocke

[57] ABSTRACT

A system indicates fault conditions in an automated banking machine journal printer (12, 106). The journal printer is supplied with paper from a paper supply (16, 112). Movement of paper by the printer is sensed by a detector (70, 124). An amount of paper remaining in the paper supply is sensed by a second detector (78, 122). The detectors are connected to an electronic circuit (74, 118) including a processor (76, 120). Fault signals are generated by said electronic circuit responsive to said detectors sensing conditions representative of paper jam, paper low and paper out conditions.

17 Claims, 7 Drawing Sheets

PAPER FEED FAULT DETECTION SYSTEM FOR AUTOMATED BANKING MACHINE

This application is a national stage entry of PCT/US96/17818 filed on Nov. 7, 1996, which is a continuation-in-part of U.S. application Ser. No. 08/568,887, filed on Dec. 7, 1995, now U.S. Pat. No. 5,725,321.

TECHNICAL FIELD

This invention relates to automated banking machines. Specifically, this invention relates to a system and method for detecting fault conditions which occur in the feeding of paper through a journal printer mechanism in an automated teller machine.

BACKGROUND ART

Automated banking machines are well known in the prior art. Automated banking machines include transaction conducting machines which can be used to perform transactions which have financial consequences to a user and/or other persons or entities. Automated banking machines may include for example devices for purchasing goods or services, devices for dispensing items of value such as vouchers, tickets, checks, notes or currency, as well as automated teller machines, which dispense cash or notes and which in some cases may be used to accept deposits, transfer funds and conduct other types of banking or financial transactions.

In many types of automated banking machines, including automated teller machines (ATMs), it is common to include a journal printer inside the machine. The function of the journal printer is to make a paper record of each transaction that has been conducted at the ATM. This enables the institution that operates the ATM to verify its electronic records and to reconstruct them in the event of a failure. An example of an ATM is shown in U.S. Pat. No. 5,483,047 the disclosure of which is incorporated herein by reference.

Journal printers typically involve recording transaction information on paper that is supplied from a paper roll. The paper from the roll is passed through the printer where the data is printed on the paper. After printing, the paper is rewound onto a take-up roll. As transactions are recorded, blank paper on the supply roll is used and the diameter of the supply roll decreases. As paper upon which data has been recorded is transferred to the take-up roll, the take-up roll increases in diameter. Eventually, when the amount of paper remaining on the supply roll is nearly depleted, the supply roll must be replaced and the paper on the take-up roll removed. The process is then repeated with additional transactions being recorded on the paper from a new supply roll.

The reliable operation of the journal printer is important to insure that the institution operating the ATM has a hardcopy record of all the transactions that have been conducted. It is undesirable for the supply roll of the journal printer to be depleted, as this results in transactions for which there may be no hardcopy record. In some existing ATMs, the need to replace the supply roll is determined electronically by storing in the memory of the machine the number of data lines printed by the journal printer since the last roll change. Such systems require for their operation that all replacement rolls be identical. This is not always the case. If the roll is either "too short" or "too long" a paper out condition may arise or excess paper may be unnecessarily discarded.

A person servicing the ATM to replace the supply roll may forget to reset the system when the paper is replaced. This can result in the automated teller machine indicating that it is in a paper low condition when in fact no such problem exists. Also, a problem such as a paper jam may occur in the middle of a roll. In this situation the technician must start a new roll and reset the machine. This may waste a significant amount of paper.

Journal printers sometimes experience paper jams. Paper jams usually result in the paper no longer moving through the printer. The printer mechanism prints data concerning a multitude of transactions on the same spot. As a result, the hardcopy record of these transactions is lost. Only the most severe paper jams that trigger signals indicating a malfunction in other components are generally detected by existing automated teller machines. For example, if the paper jam condition is sufficient to prevent the printer mechanism from moving as required to produce characters on paper, a printer fault indication may be given. However in most circumstances, paper jams are not sufficiently severe to impact the operation of other components. Such paper jams go undetected until a visual inspection is made by a service technician.

Other types of fault conditions may arise with regard to a journal printer. A technician may remove a spent roll and forget to put in a new one even though the machine has been reset. Paper rolls may also have breaks at splices. In either case the journal printer will become inoperative and this condition may go undetected for some time.

Problems may also result when a replacement roll has not been properly installed. The ATM may be run for an extended time before it is discovered that paper is not feeding through the journal printer.

Thus there exists a need for a system and method for indicating fault conditions with paper feeding to a journal printer in an automated banking machine.

DISCLOSURE OF INVENTION

It is an object of the present invention to provide an apparatus for indicating a fault condition in a system in which a printer is supplied with paper from a paper supply.

It is a further object of the present invention to provide an apparatus for indicating a paper jam condition with a journal printer in an automated banking machine.

It is a further object of the present invention to provide an apparatus for indicating a paper low condition for a supply roll supplying a journal printer in an automated banking machine.

It is a further object of the present invention to provide an apparatus for indicating fault conditions in a system including a journal printer in an automated banking machine which is supplied by a paper roll and which prevents overrunning of the roll.

It is a further object of the present invention to provide an apparatus for indicating fault conditions in a system including a journal printer in an automated banking machine which detects the movement of journal printer paper and which determines that such paper is moving in coordination with a journal printer.

It is a further object of the present invention to provide an apparatus for indicating fault conditions in a system including a journal printer in an automated banking machine which detects the movement of a journal printer supply roll and which determines that such roll is moving in coordination with a journal printer.

It is a further object of the present invention to provide an apparatus for detecting proper movement of a journal printer paper which enables readily changing the supply roll.

It is a further object of the present invention to provide an apparatus for detecting the proper movement of a journal printer supply roll which apparatus is engaged with said supply roll so as to indicate the movement thereof but which is readily disengagable from said supply roll to enable the replacement thereof.

It is a further object of the present invention to provide an apparatus for indicating fault conditions with a paper feed from a roll to a printer, which apparatus may be used with rolls of varying size.

It is a further object of the present invention to provide an apparatus for indicating improper loading or a failure to load, a paper supply to a printer.

It is a further object of the present invention to provide an apparatus for detecting severance of paper from a paper supply to a printer.

It is a further object of the present invention to provide a method for indicating a fault condition in a system in which a journal printer is supplied with paper from a paper supply.

Further objects of the present invention will be made apparent in the following Best Modes for Carrying Out Invention and the appended claims.

The foregoing objects are accomplished in preferred embodiments of the present invention by an apparatus for indicating fault conditions in a transaction recording system within an automated banking machine. The system includes a journal printer that is supplied with paper from a paper supply. The printer operates to move paper from the supply and to print transaction data thereon. The paper with the printed data is rewound on to a take-up roll.

In a first embodiment the paper supply roll is supported on a spindle. A wire spring extending from the spindle serves as a connecting member and connects the spindle to the supply roll. As a result, the spindle is rotatably engaged with the roll so as to move therewith. An encoder member is supported on one end of the spindle. The encoder member includes a plurality of uniformly spaced indicia which in the preferred form of this embodiment is a plurality of slotted openings.

An optical detector is positioned adjacent to the encoder member. The detector operates to detect rotation of the encoder member which is indicative of rotation of the paper roll. A drag mechanism is associated with the spindle which prevents overrunning of the supply roll as paper is removed therefrom by the printer.

In a second embodiment of the invention paper is supplied to the printer from a roll or other type paper supply. The printer includes a printer drive mechanism which engages the paper and moves it through the printer in coordination with the printing on the paper. The paper drive mechanism as part of a first paper moving device. The paper with the printed data is rewound onto a take-up roll. The take-up roll is moved by a take-up roll drive mechanism.

Between an area of engagement of the paper with the printer drive mechanism and the take-up roll the paper passes through a detection area which comprises a gap. The paper is movable in the gap both in a direction of paper movement from the printer to the take-up roll, as well as in a direction that is generally perpendicular to the direction of paper movement.

The operations of the printer drive mechanism and the take-up roll drive mechanism are coordinated by a coordinating mechanism which is also referred to herein as a coordinating device. The printer drive preferably first moves the paper towards the take-up roll and a time thereafter the take-up roll drive mechanism moves the take-up roll to take up the slack in the paper. This causes the paper to move back and forth in the perpendicular direction in the gap.

An optical detector is positioned adjacent to the gap. The optical detector is positioned to detect movement of the paper in the perpendicular direction. In this manner the detector operates to detect movement of the paper in a manner indicative of the proper operation of the printer drive and take-up roll drive mechanisms. The take-up roll drive mechanism is part of a second paper moving device.

Both embodiments of the system further include a second detector adjacent to the paper supply. The second detector serves as a paper low detector and preferably senses a side face portion of the paper roll, stack or other form of supply. The second detector is operative to provide a signal when the diameter or size of the supply has fallen to a predetermined level.

An electronic circuit, which includes a processor, is in operative connection with the printer and the first and second detectors. The processor is programmed to provide fault signals when a combination of certain conditions are detected in accordance with the programming of the processor.

In operation, a first fault signal representative of a paper jam condition is generated by the electronic circuit if the second detector senses sufficient paper, but the first detector has failed to sense movement of the paper after the printer has operated to print a number of lines. This may be a failure to sense rotation of the spindle shaft or cyclic movement of the paper in the perpendicular direction in the gap. This first fault signal is indicative that the printer is attempting to print several lines of data on the paper but that the paper is not moving. The first fault signal is also generated in conditions where the paper has broken, such as at a splice, or when a replacement roll or stack has not been properly installed.

The electronic circuit provides a paper low signal when the second detector senses that the paper supply has been reduced to a sufficiently small size that replacement is warranted. The paper low signal is given if the first detector is continuing to sense that the paper is still moving. This is indicative that the journal printer is still operating despite the paper running low.

The electronic circuit further provides a paper out signal when the printer has printed the number of lines during which time movement of the paper should have been sensed, and if at the same time the second detector does not sense the presence of paper. This is indicative that the paper supply has been depleted and that a hardcopy record of transaction data is not being retained. This second fault signal indicative of a paper out condition is also given in circumstances when a replacement roll or other supply was not installed or was improperly installed due to a mistake by a service technician.

BEST MODE FOR CARRYING OUT INVENTION

Figure 1:
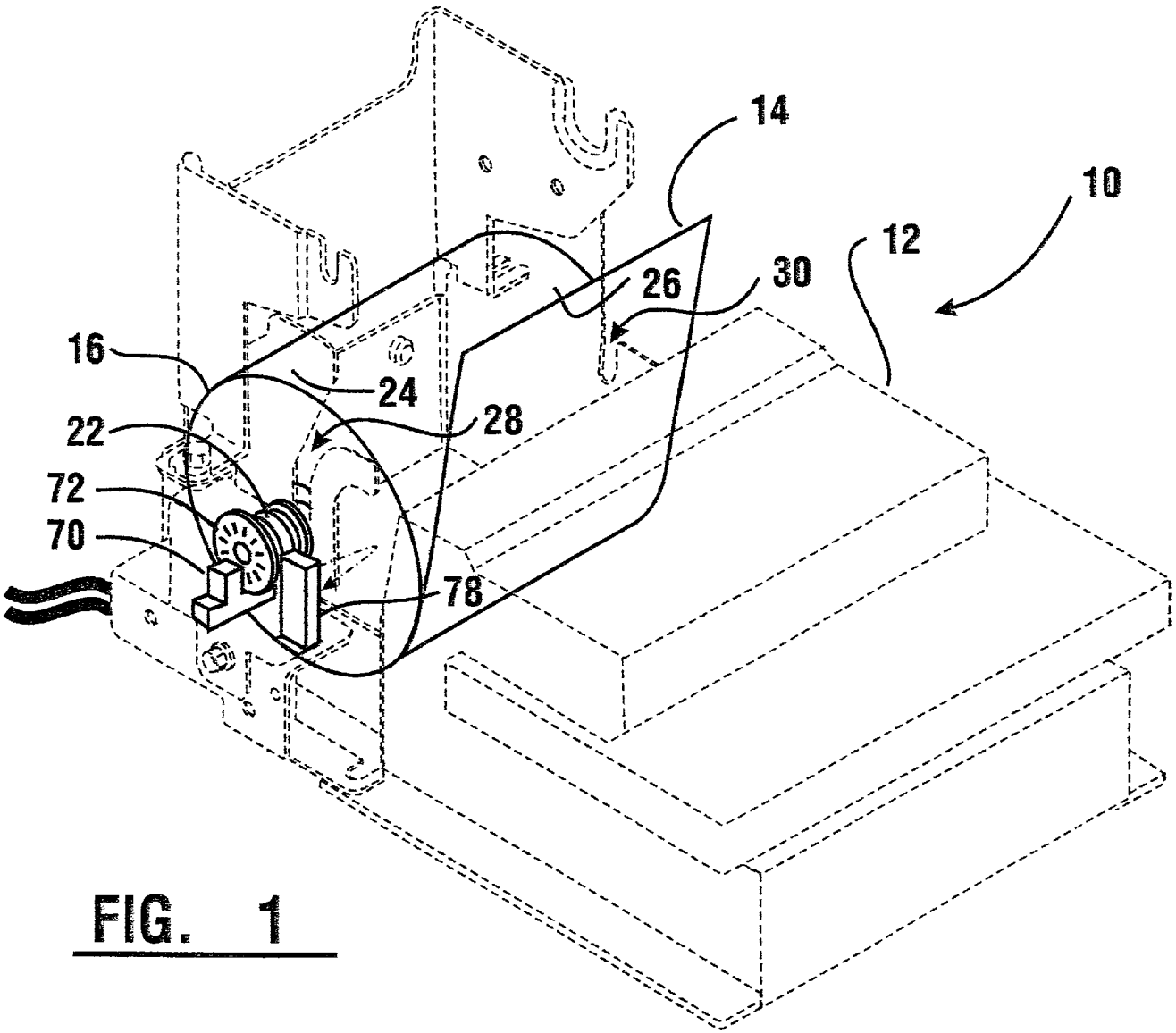
FIG. 1 is an isometric view of a journal printer including a first embodiment of the fault indicating apparatus of the present invention.

Referring now to the drawings and particularly to FIG. 1, there is shown therein a first embodiment of the fault indicating apparatus of the present invention generally indicated 10. The apparatus includes a journal printer generally indicated 12. Journal printer 12 includes mechanisms known in the prior art for producing printed data on paper in a conventional manner.

Figure 2:
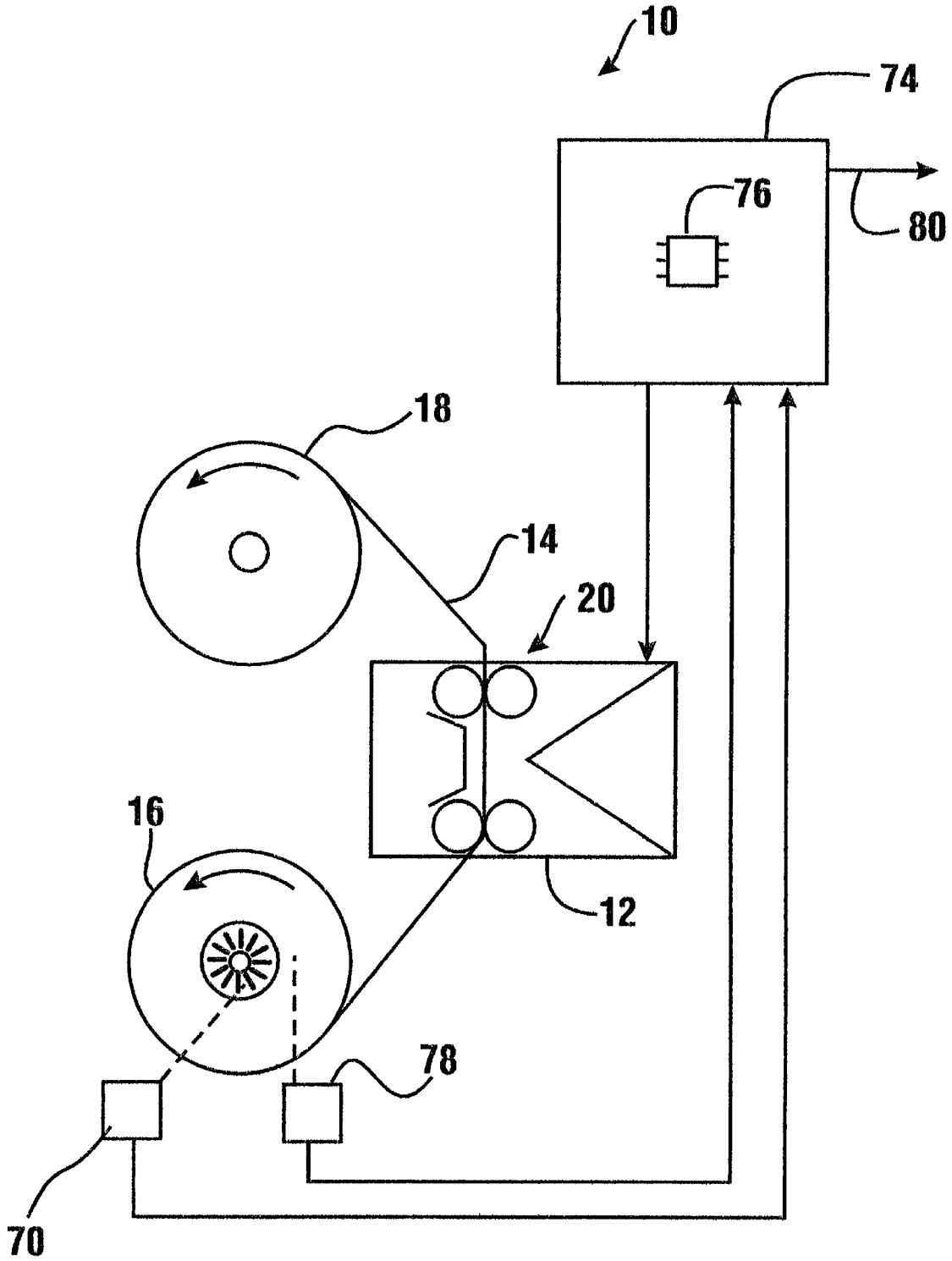
FIG. 2 is a schematic view of a journal printer including the first embodiment of the fault indicating apparatus of the present invention.

Paper generally indicated 14, is fed from a paper supply roll 16 to printer 12. As schematically indicated in FIG. 2, paper that has been printed on by the journal printer 12 is stored on a take-up roll 18. Printer 12 includes a conventional type drive schematically indicated 20 for moving the paper 14 therethrough after each line of data has been printed thereon. Take-up roll 18 is also driven by a conventional mechanism so as to rewind and store on the take-up roll the paper that has been printed on by journal printer 12.

Figure 3:
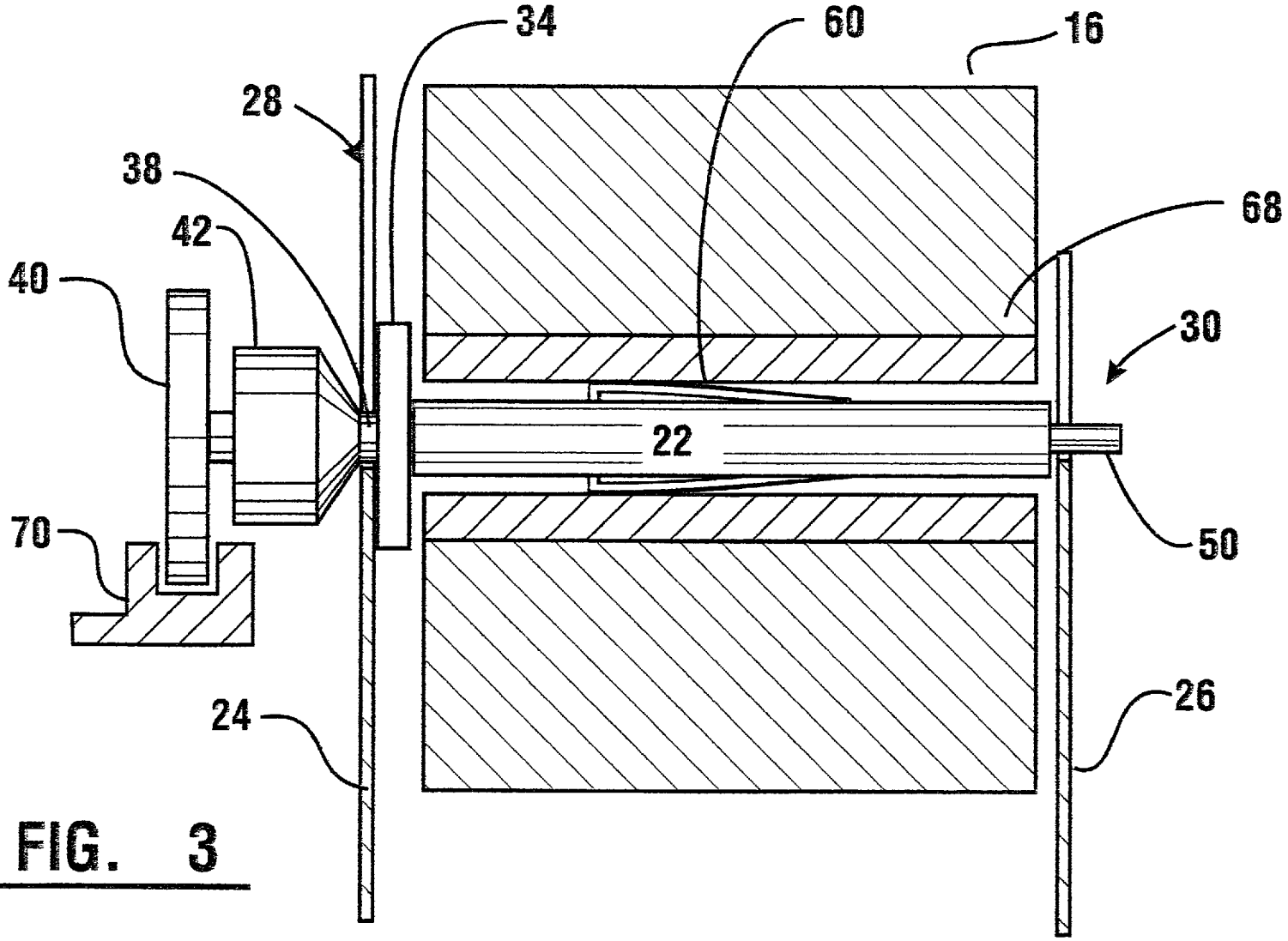
FIG. 3 is a sectional side view of a paper supply roll, spindle and spindle rotation detector of the first embodiment of the present invention with the inside diameter of the paper roll core exaggerated to show the action of a pair of spring arms connecting the roll and the spindle.

Paper supply roll 16 is supported on a spindle generally indicated 22. The spindle is shown in detail in FIGS. 4 and 5. Spindle 22 is supported on a first side by a first vertically extending wall 24. Spindle 22 is supported at an opposed side by a second vertically extending wall 26. First wall 24 includes a first slot 28 therein. First slot 28 includes an open end and a closed end. The spindle is supported at the closed end of slot 28 when in the operative position as shown in FIG. 3. However, the spindle may be removed from the slot 28 through the open end to enable replacement of the supply roll and then reinstalled in a manner later discussed.

Second wall 26 includes a second slot 30. Second slot 30 has open and closed ends. The spindle is supported at the closed end of the second slot when in the operative position as shown in FIG. 3. Similarly, the spindle may be removed through the open end of the slot when the supply roll is depleted and reinstalled after the roll is replenished.

Figure 4:
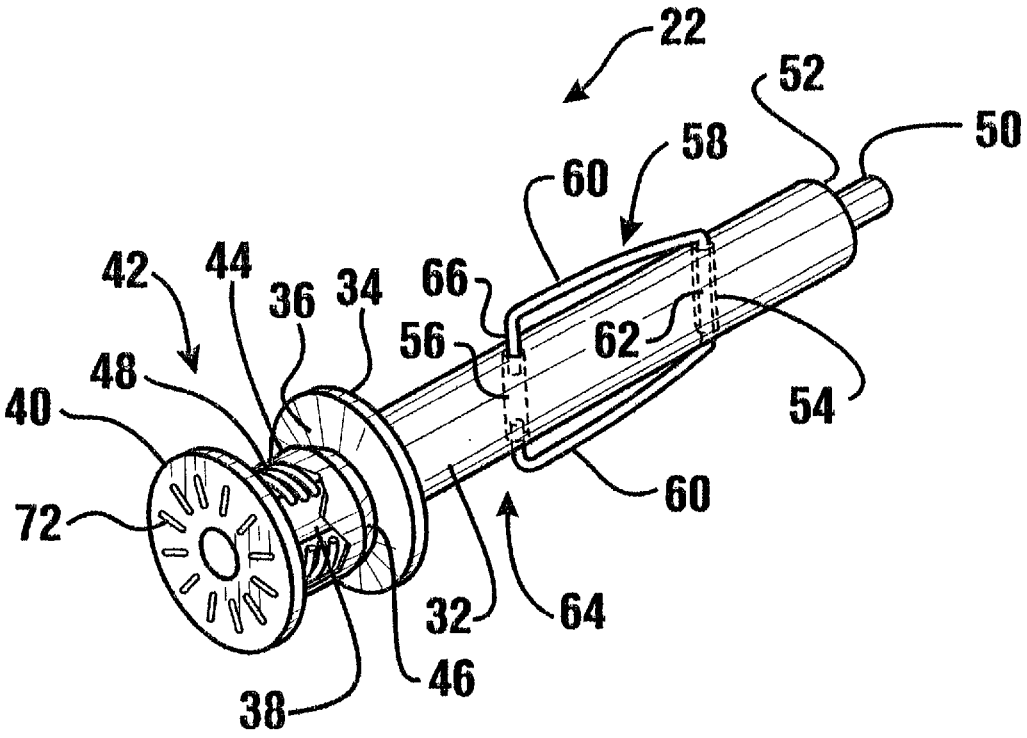
FIG. 4 is an isometric view of the spindle of the first embodiment of the present invention shown with the spring arms extended.

Spindle 22 is shown in detail in FIG. 4. Spindle 22 includes a spindle shaft portion 32. A flange portion 34 is located at a first end of spindle shaft portion 32. A flange portion 34 includes a flat circular face 36, the purpose of which is later discussed.

An encoder support shaft portion 38 extends axially outward from flange portion 34. Encoder support shaft portion 38 supports an encoder member 40. In the preferred form of the first embodiment of the invention, encoder member 40 is an encoder wheel with a plurality of radially extending slotted openings positioned at a plurality of uniformly spaced radial increments thereon.

A retainer member 42 is movably positioned between flange portion 34 and encoder member 40. Retainer member 42 is a generally hollow member with an opening (not shown) through which shaft portion 38 extends. The retainer member is enabled to move in an axial direction on the encoder support shaft portion 38. Retainer member 42 includes externally a cylindrical portion 44 and a generally frustoconical portion 46. Generally frustoconical portion 46 includes the opening therethrough that enables retainer member 42 to move relative to shaft portion 38.

A compression spring 48 is housed in a generally cylindrical pocket inside retainer member 42. Compression spring 48 is a coil spring that extends coaxially with encoder support shaft portion 38. Spring 48 biases the generally frustoconical portion 46 of the retainer towards face 36 of the flange portion 34. However, in response to a separating force, the frustoconical portion 46 may be moved away from face 36.

A guide shaft portion 50 is positioned at an opposite end of spindle shaft 32 from flange 34. Guide shaft portion 50 is smaller in diameter than spindle shaft portion 32. A radially extending step 52 extends between guide shaft portion 50 and spindle shaft portion 32.

Spindle shaft portion 32 includes a diametrically extending opening 54 therethrough. A second opening 56 in spindle shaft portion 32 is axially disposed from opening 54 in the direction of flange portion 34. A generally u-shaped wire spring 58 extends between openings 54 and 56. Spring 58 includes a pair of outwardly biased spring arms 60 which extend from a spring base 62. Spring base 62 extends through opening 54 in shaft portion 32 as shown in FIG. 4. Spring arms 60 each include free ends generally indicated 64 which each have radially in-turned portions 66. In-turned portions 66 extend into opening 56 in spindle shaft portion 32.

Figure 5:
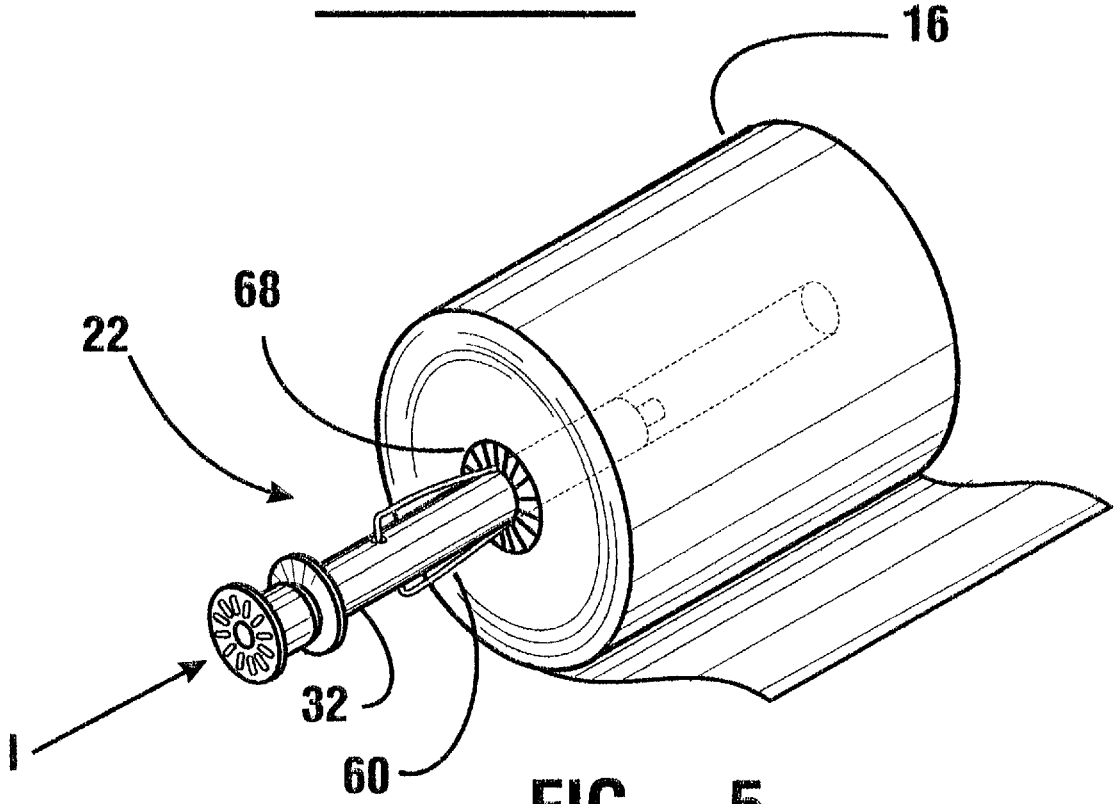
FIG. 5 is an isometric view showing the spindle partially inserted into a paper supply roll.

As shown in FIG. 5, when paper supply roll 16 is installed on spindle 22, spindle shaft portion 32 is inserted into a core 68 at the center of the paper roll 16. As the spindle shaft is inserted into the core, the engagement of the core with the spring arms moves the spring arms against the biasing force of the wire spring so that the in-turned portions 66 are moved further into opening 56 in the spindle shaft portion. The outward biasing force of the spring arms maintains engagement between the spindle 22 and the core 68 of the paper roll 16. As a result, the spring arms 60 serve as connecting members for connecting the spindle to the paper roll so that the spindle is rotatably engaged therewith. This enables the encoder member 40 to move in response to movement of the paper roll. This enables the detection of fault conditions in a manner hereinafter discussed.

The spindle 22 is installed in the roll 16 by movement of the spindle in the direction of arrow I as shown in FIG. 5 until flange portion 34 engages a side face of the core and paper roll. The spindle 22 is then installed in supported connection with walls 24 and 26. Installation into supported connection with the walls is accomplished by engaging guide shaft portion 50 in second slot 30 and engaging the encoder support shaft portion 38 in the slot 28. Engaging encoder support shaft portion 38 in slot 28 necessitates the movement of retainer member 42 away from flange portion 34 a sufficient distance to enable wall 24 to extend therebetween. This is accomplished by engaging the tapered generally frustoconical portion 46 of the retainer in the open end of slot 28 and moving spindle 22 downward. This downward movement biases the retainer member 42 axially outward against the biasing force of compression spring 48. This enables spindle 22 to be moved so that shaft portion 38 is supported at the closed end of slot 28 as shown in FIG. 3.

When the spindle 22 is supported in slots 28 and 30 as shown in FIG. 3, retainer member 42 applies a biasing force against the outer surface of first wall 24. This biasing force causes wall 24 to be in compressed sandwiched relation between flange portion 34 and retainer member 42. The frictional forces that are applied by face 36 of flange portion 34 on the inside of wall 24 combined with the frictional force of the retainer member 42 engaging the outer surface of wall 24, act to resist rotation of spindle 22. Because spindle 22 is connected to paper roll 16 through the spring arms 60, these structures act as a drag mechanism to prevent spindle 22 from freely rolling in response to forces applied thereto. As a result, when roll 16 is moved in response to printing operations being conducted by journal printer 12, roll 16 is prevented from overrunning by the drag mechanism.

The apparatus of the first embodiment of the present invention further includes a detector 70. In the preferred form of the invention detector 70 is an opto-interrupter sensor. Detector 70 is operable to detect the passage of a beam of light through the openings 72 in the encoder member 40 as the openings are aligned with the sensor. As spindle 22 rotates, detector 70 sequentially senses the passage and blockage of light as openings 72 are aligned in the sensor.

As schematically shown in FIG. 2, detector 70 is electrically connected through an appropriate interface to an electronic circuit schematically indicated 74. Electronic circuit 74 includes a processor 76 which operates in accordance with the steps of a computer program hereinafter described. Electronic circuit 74 is also connected to journal printer 12 for purposes that are later discussed.

The apparatus of the present invention further includes a second detector 78. Second detector 78 is also preferably an opto-electric detector. Second detector 78 is positioned between the spindle and the journal printer. Second detector 78 preferably operates to direct a light beam against a side face portion of paper supply roll 16 and to detect the light reflected from such surface. As a result, when the diameter of roll 16 has decreased so that the side face surface is no longer present in the area adjacent second detector 78, this condition may be sensed as shown in FIG. 2. In other embodiments other types of detectors may be used instead of electro-optical detectors. Second detector 78 is electrically connected through an appropriate interface to the electronic circuit 74. Electronic circuit 74 operates as schematically indicated in FIG. 2 to output electrical signals on a line schematically indicated 80.

Electronic circuit 74 operates to output fault indication signals in response to a determination that there is a paper jam or a comparable condition, that the paper on the supply roll is low, or that the paper on the supply roll is out or a comparable condition. These signals are given in response to processor 76 which executes generally the computer program steps indicated in FIG. 6.

It will be understood by those skilled in the art that because the diameter of paper supply roll 16 varies as paper is used, the amount that the spindle will rotate in response to printer 12 removing a predetermined amount of paper from the roll will vary. The spindle will rotate a lesser amount for a given length of paper when the roll is new. The roll will gradually increase the angular displacement for a given amount of paper as the roll approaches depletion.

Printer mechanisms are generally set up such that each line of printed data occupies a predetermined width on the paper. This width extends in a transverse band. Each time the printer is instructed by the printer driver control to move to the position to print the next line of data, the drive 20 of the printer operates to attempt to move the paper forward a predetermined distance. Because the printer advance for each line of data is constant, but the amount of associated rotation of the spindle and the attached encoder member 40 varies, the processor of the present invention is programmed so as to prevent the generation of fault signals in circumstances where the encoder member has only moved slightly due to the large diameter of the roll.

Figure 6:
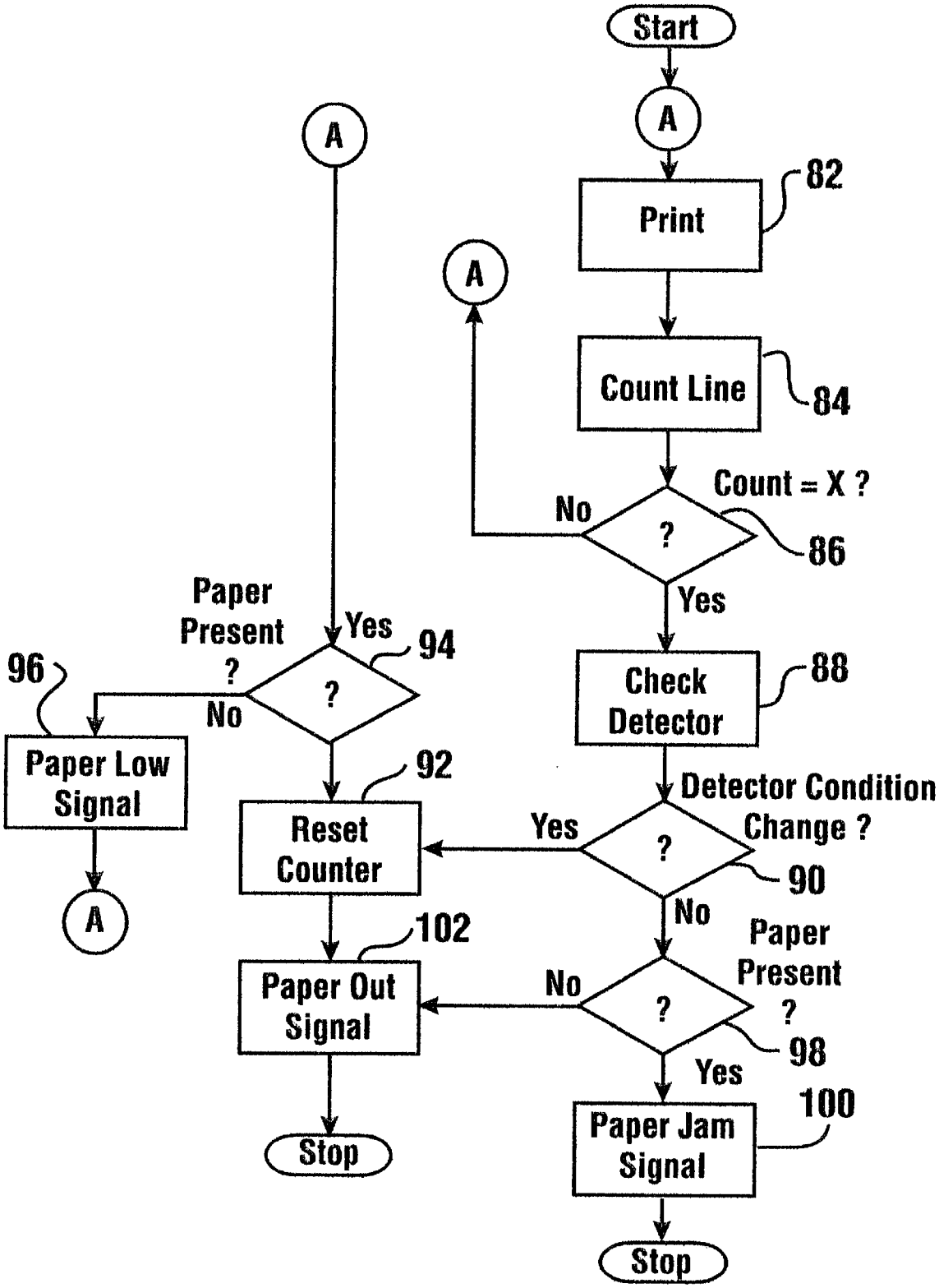
FIG. 6 is a flow chart of the computer program executed by the processor of the electronic circuit used in the fault indicating apparatus of the present invention.

As shown in FIG. 6, the processor 76 is connected to printer 12 so as to enable the printing of a line of data on the paper at a step 82. A counter is then incremented at a step 84 to note that an additional line has been printed. At a step 86, the counter is checked to determine if the number of lines that have been printed is equal to a set number. This set number is preprogrammed so that for the largest roll to be installed on spindle 22 the encoder member must have moved sufficiently so as to produce a change in signal at detector 70 after the preset number of lines is printed. If the counter has not yet reached this preset limit, the program returns to print the next line. If it has, the program moves on.

At a step 88, the processor checks to determine if there has been a change in signal from detector 70. This would indicate that the spindle has rotated enough to indicate at least one change from "dark" to "light" or vice versa. At a step 90, a decision is made as to whether such a change in signal from detector 70 has occurred. If at least one change in signal has occurred, the counter is reset at a step 92. A step 94 is then executed to check if paper is sensed by second detector 78. If paper is present adjacent the second detector, then the processor enables the program to return. The printer will then print the next line. However if paper is not sensed adjacent to second detector 78, a "paper low" signal is generated at step 96. Because it is desirable to operate the journal printer as long as possible, even if the paper is low, the processor continues to operate the printer.

If in executing the computer program, it is determined in step 90 that the encoder has not changed condition since the last check, this is representative of a problem. The processor then executes step 98 wherein the processor seeks to determine if paper is sensed adjacent to second detector 78. If paper is present, but the spindle is not moving, the processor indicates a first fault detection signal representative of a paper jam or a comparable fault condition at a step 100. As it is often not desirable to operate the ATM without a journal printer, in addition to giving a paper jam signal, the processor or the paper jam signal may also operate to stop further operation of the ATM after it has completed the pending transaction.

The first fault detection signal may be generated in response to conditions other than paper jams. For example, the signal will also be given if the paper is severed or broken. This may be due to a break at a splice in the roll. The first fault detection signal will also be generated if the supply roll has not been properly installed and seated in the slots in the side walls. This will cause the roll to bind and not unwind. In each case the first fault detection signal indicates that ample paper is present but paper is not being fed in response to the printer.

Alternatively, if at step 98 it is determined that no paper is present adjacent to second sensor 78 and the encoder is not moving, then a "paper out" signal is generated at a step 102. Further, as previously discussed, in addition to generating the paper out signal, which is a second fault signal, the processor or the fault signal may operate to discontinue operation of the ATM after completing the then pending transaction.

The "paper out" signal may also be given in other comparable situations. These would include situations in which a technician has taken out a spent roll and forgotten to put in a new roll, or when a new roll has been installed so improperly that its presence cannot be sensed. In these situations, the transaction information is not being recorded due to absence of paper.

The force applied by the drag mechanism on the spindle insures that the encoder member accurately reflects the movement of paper through the journal printer. In the event of even a minor paper jam or paper feeding problem which prevents the proper operation of the printer, a fault indication signal is given. In addition, the present invention enables giving accurate signals representative of paper low and paper out conditions. This is superior to basing replacement of the paper supply roll on estimates on the amount of paper remaining. It is also not necessary to replace the roll and reset a paper counter after a paper or printer problem is corrected.

An additional advantage is that while the apparatus of the present invention is highly reliable, it does not interfere with the replacement of the paper rolls or complicate the threading of the paper through the journal printer.

It will be understood by those skilled in the art that while an opto-interrupter type sensor has been used as the detector for detecting rotation of the spindle in the preferred form of the first embodiment of the invention, other rotation sensors may be successfully used in other embodiments. These include those detectors that sense other types of indicia or features on a member that is in connection with the spindle.

While the spring arms of the wire spring serve as the connecting members in the preferred form of the first embodiment, other types of connecting members may be used to connect the paper roll and the spindle shaft. These include other types of spring members as well as ridges or other contours which serve to provide a rigid rotational connection between the spindle and the roll.

While a reflective type detector is used for the second detector in the preferred embodiment, other types of detectors may be used. These other detectors include detectors which sense the paper between the spindle and the journal printer by way of sensing the side surface of the supply roll or other paper feature.

Figure 7:
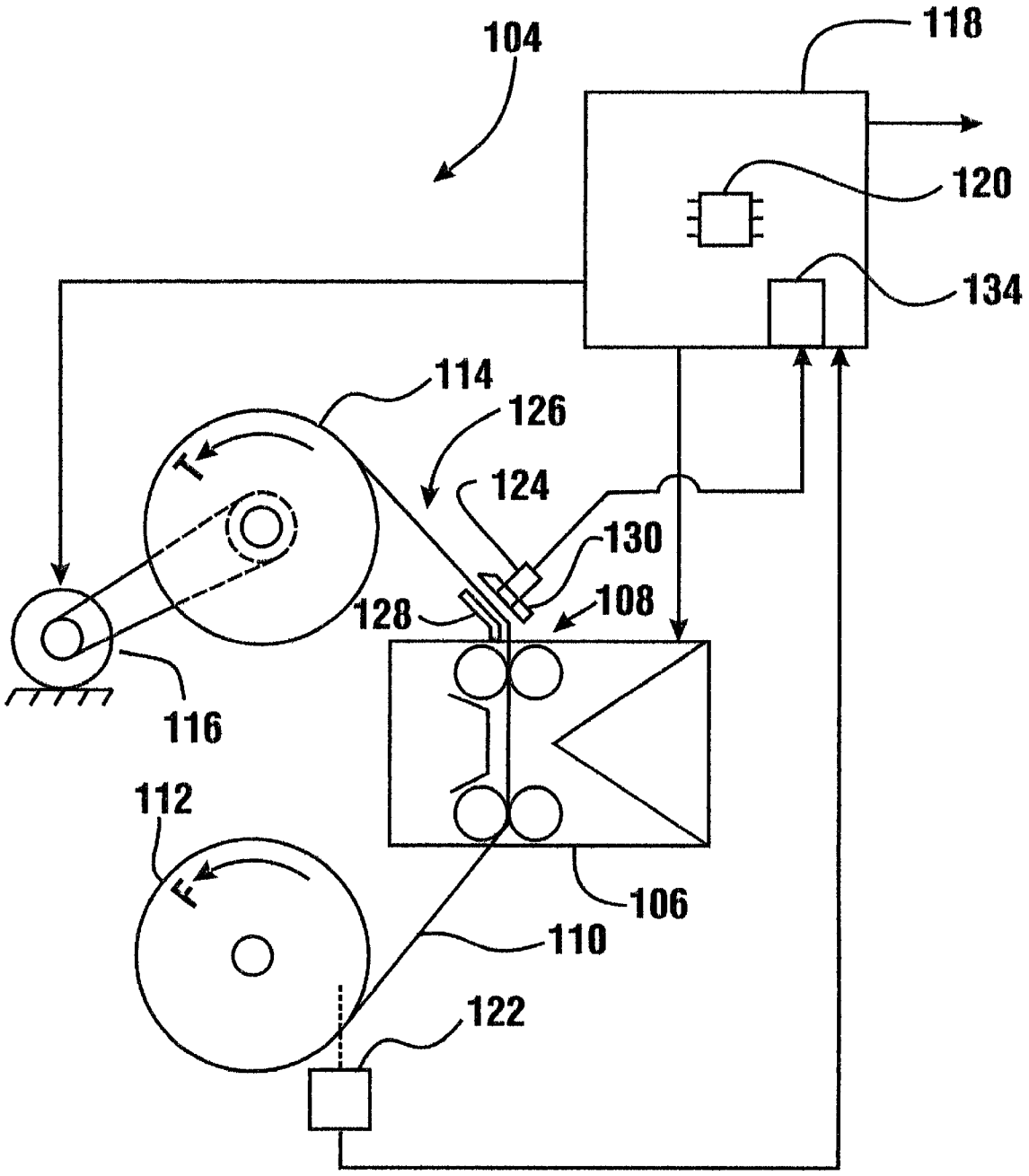
FIG. 7 is a schematic view of a journal printer including a second embodiment of the fault indicating system of the present invention.

An alternative embodiment of a fault indicating apparatus generally indicated 104 is shown in FIG. 7. The second embodiment is similar to the first embodiment and includes a journal printer 106. Printer 106 includes a printer drive mechanism schematically indicated 108. The printer drive mechanism 108 moves paper 110 through the printer in coordination with the printing of lines of characters thereon.

As in the first described embodiment the printer drive mechanism 108 causes paper to be pulled from a paper supply roll 112. Roll 112 rotates in the direction indicated by Arrow F responsive to movement of the paper by the printer drive mechanism. In this second embodiment the paper supply roll may be rotatably supported on a spindle or in another suitable manner. Alternatively in this second embodiment another form of paper supply such as a stack of fanfold paper may be used instead of a supply roll.

Paper 110 that is moved by the printer drive mechanism is rewound on a take-up roll 114. The take-up roll is moved in the direction indicated by the Arrow T by a take-up roll drive mechanism schematically indicated 116.

As in the first described embodiment, the second described embodiment includes an electronic circuit 118 similar to electronic circuit 74 except as otherwise described. Electronic circuit 118 includes a processor 120. The second embodiment also includes a second detector 122 similar to detector 78, which is positioned adjacent the paper supply and is in communication with the electronic circuit 118.

Unlike the first embodiment a detector 124 is positioned between an area where said printer drive mechanism 108 engages the paper and where the paper engages the take-up roll. The detector 124 is mounted adjacent to a gap 126. The paper 110 extends in the gap and is freely movable therein between the printer drive mechanism and the take-up roll. Gap 126 is preferably sized so that the paper is movable in the gap in a direction that is generally perpendicular to a plane of the paper and the direction of movement of the paper through the gap toward the take-up roll.

Gap 126 is bounded at a first side by a first guide 128. Guide 128 includes a paper engaging surface that is preferably angled in a direction generally toward the take-up roll 114 as shown. The relative orientation of take-up roll 114 and guide 128 is such that the paper will generally be positioned adjacent to guide 128 when the paper is relatively taut between the printer drive mechanism and the take-up roll. This is preferably true for all diameters of the take-up roll. However, in other embodiments other paper guiding mechanisms may be positioned between guide 128 and the take-up roll to maintain the paper generally adjacent thereto when the paper is taut.

Gap 126 is bounded at a side opposed from guide 128 by a guide 130. Guide 130 has a paper engaging surface that is preferably angled similar to guide 128. Guide 130 in the preferred embodiment is a tear bar which includes a serrated edge 132 at its upper surface (see FIG. 8). Edge 132 facilitates cutting the paper when that is desirable, such as when manually preparing a free end of the paper to engage take-up roll 114. Detector 124 preferably extends in an opening in guide 130. In this embodiment detector 124 is preferably of the electro-optical detector type previously discussed. In other embodiments other types of suitable detectors may be used.

The apparatus of the second embodiment operates in a manner similar to the first embodiment except as otherwise explained. The printer 106 operates under the control of circuit 118 and processor 120 to print lines of characters on the paper 110. The printer drive mechanism 108 moves the paper, generally one line width at a time, as printing is conducted.

The take-up roll drive mechanism 116 is also operated responsive to the control of the electronic circuit 118 and the processor. In the second embodiment the operations of the printer drive mechanism 108 and the take-up roll drive mechanism 116 are coordinated so they operate in sequence. Specifically, the drive mechanisms are operated so that the printer drive mechanism moves the paper toward the gap 126 and the take-up roll 114, while the take-up roll remains stationary. This results in slack in the paper between the area where the printer drive mechanism engages the paper and the take-up roll. After the printer drive has moved the paper, the take-up roll drive mechanism 116 moves the take-up roll 114 to remove the slack from the paper in the area between the printer drive mechanism and the take-up roll.

Figure 8:
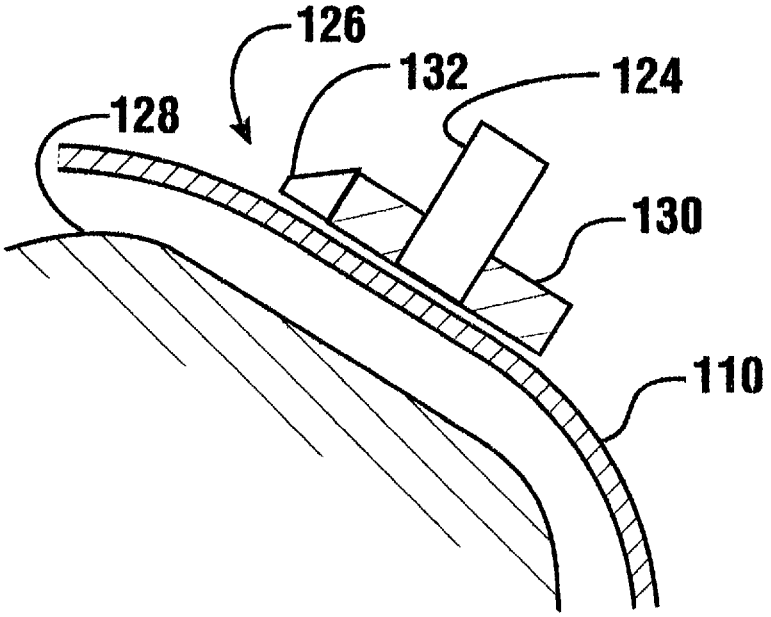
FIG. 8 is an enlarged cross sectional view of an optical detector of the second embodiment with paper in a first position adjacent the detector.
Figure 9:
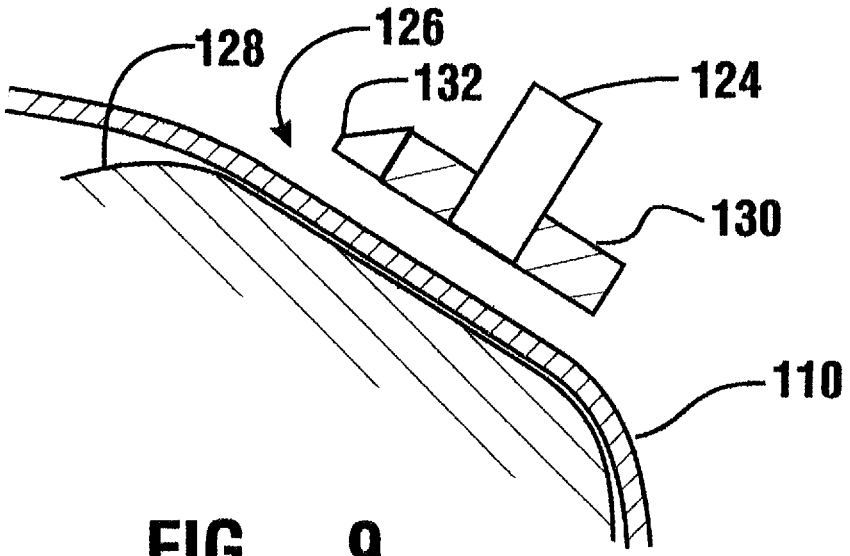
FIG. 9 is an enlarged cross sectional view similar to FIG. 8 but with the paper in a second position disposed from the detector.

The coordinated movement of the printer drive mechanism 108 and the take-up roll drive mechanism 116 causes the paper 110 to move in the gap 126 between the positions shown in FIGS. 8 and 9. In the preferred form of the second embodiment, when the printer drive mechanism 108 has moved the paper 110, and the take-up roll drive mechanism 116 has not yet moved, the paper extends in the gap generally as shown in FIG. 8. The slack in the paper and the orientation of guides 128 and 130 causes the paper to move adjacent to guide 130 and detector 124.

When the take-up roll drive mechanism 116 moves the paper a time increment after the printer drive mechanism, the paper moves in the perpendicular direction in gap 126. As the take-up roll drive mechanism takes the slack out of the paper, the paper moves adjacent to guide 128 as shown in FIG. 9. The paper remains in this position until the printer drive mechanism 108 again moves the paper to the position shown in FIG. 8.

The cyclical sequential back and forth movement of the paper in the gap is sensed by detector 124. The detector 124 is operative to output signals in a manner similar to detector 70 of the first embodiment responsive to paper movement. These signals from detector 124 are delivered to circuit 118.

In the preferred form of this embodiment, circuit 118 includes a self-calibrating triggering sub-circuit 134. Sub-circuit 134 is operative to provide a trigger signal to circuit 118 each time the paper moves between generally the positions shown in FIGS. 9 and 8.

Sub-circuit 134 is operative to compensate for changes in signals from detector 124 due to changes in conditions such as paper color, paper weight, the diameter of the take-up roll, accumulation of dirt and other factors which may affect the level of sensed reflectance as the paper moves or the amount of paper movement. In an embodiment of the invention, sub-circuit 134 is operative to adjust how much light must be sensed as reflected from the paper before it generates its signal during each cycle. This is accomplished based on the amount of light that is reflected from the paper in the area adjacent the detector.

The detector 124 is preferably oriented so that when the paper moves in each cycle from generally the position shown in FIG. 9 to generally the position shown in FIG. 8, the area of the paper sensed by the detector when the paper was disposed from the detector is generally the same area that is sensed when the paper is moved closer to the detector. As a result, the generation of the trigger signal from sub-circuit 134 is based on a difference in the signals from detector 124 as generally the same area of the paper is moved between the two positions. Sub-circuit 134 operates so that the threshold level at which the sub-circuit will trigger is appropriately adjusted each time the paper drives move the paper to the position shown in FIG. 9. The threshold level for generating the signal is determined as a function of the delta or change in reflectance detected from the paper when the paper is disposed away from the detector. In various embodiments the threshold may be established as a percentage change in reflectance. However in other embodiments it may be a complex function. This depends on the printing and paper types used in the particular system. Of course while in this embodiment the threshold level for generating a signal is adjusted based on reflectance when the paper is disposed the extreme distances from the detector, in alternative embodiments the adjustment to the level may be based on the signals from the detector when the paper is in other positions.

Through the use of self-calibrating sub-circuit 134 a signal is more reliably provided each time paper moves between generally the positions shown in FIGS. 9 and 8. This enables detector 124 to be positioned adjacent areas where the reflectance of the paper varies due to printing thereon. The sub-circuit also compensates for differences in reflectance during paper movement cycles due to paper color, weight and other factors, while indicating a failure condition through lack of a paper movement signal when the drives operate in a manner which should cause the paper to move in the gap but no movement occurs.

In operation of this embodiment signals are generated by sub-circuit 134 responsive to the cyclical paper movement in coordination with movement of the printer and take-up roll drive mechanisms. These signals are indicative of proper paper movement like those produced by detector 70 and encoder 40 of the first embodiment.

The processor 120 executes a computer program which includes the steps described in connection with FIG. 6 to detect and indicate fault conditions generally in the manner previously discussed. It should be understood however that the set number used for comparison in step 86 is set to a number of lines that would be printed to produce at least one change of condition of the paper in the gap.

The second embodiment of the invention avoids the need to employ a spindle in connection with the supply roll 112. Rather a supply roll can be supported in a cradle or other manner. Further, the second embodiment may be used with fanfold paper or another type of paper supply other than a roll. Of course when an alternative form of paper supply is used, detector 122 must be appropriately positioned to detect when the paper supply is low.

Although the take-up roll drive mechanism 116 is schematically shown in FIG. 7 as electrically operated by the electronic circuit, it should be understood that in embodiments of the invention it may be mechanically operated. For example, the take-up roll drive may be mechanically connected with the printer drive mechanism. Such connection may include mechanical linkages which provide the coordinated operation of the printer drive and the take-up roll previously described. In this manner the take-up roll drive operates responsive to the signals by the control circuit to the printer drive.

While the preferred form of the second embodiment provides for moving the paper in the gap adjacent to a detector in response to paper being fed, and away from the detector when slack is removed, alternative embodiments may work in a different manner. For example, the signals indicative of paper movement could be based on movement away from a detector or a detector may be placed in connection with guide 128. Alternatively, the detector could be positioned adjacent a location of the paper where no printing occurs to simplify or eliminate the need for the self-calibrating sub-circuit. Alternatively, other paper guiding mechanisms may be used for positioning the paper in a manner which confirms proper paper movement.

While the electronic circuitry of the preferred embodiment provides a signal in response to ceasing to sense the cyclical movement of the paper in the gap or detection area, other embodiments may produce different type signals when such cyclical movement is sensed or ceases to be sensed, or may change the signal type by ceasing a signal upon no longer sensing the cyclical movement of the paper. Other embodiments of the invention may move discrete sheets or a continuous web of paper in the paper path, and may move the paper in a paper path which does not include a printer, or which includes other types of devices which act upon or respond to the paper. Those skilled in the art may devise numerous embodiments employing the teachings of the present invention.

Thus the new fault indicating apparatus of the present invention achieves the above stated objectives, eliminates difficulties encountered in the use of prior devices and systems, solves problems and attains the desirable results described herein.

In the foregoing description, certain terms have been used for brevity, clarity and understanding. However no unnecessary limitations are to be implied therefrom because such terms are for descriptive purposes and are intended to be broadly construed. Moreover, the descriptions and illustrations herein are by way of examples and the invention is not limited to the details shown and described.

In the following claims, any feature described as a means for performing a function shall be construed as encompassing any means capable of performing the recited function, and shall not be limited to the particular means used for performing the function in the foregoing description, or mere equivalents.

Having described the features, discoveries and principles of the invention, the manner in which it is constructed and operated and the advantages and useful results attained; the new and useful structures, devices, elements, arrangements, parts, combinations, systems, equipment, operations, methods, processes and relationships are set forth in the appended claims.

We claim:

1. Apparatus comprising:

a paper path, wherein the paper moves in the paper path from a first end to a second end, the paper path including a detection area, wherein paper moving from the first end to the second end generally moves in a first direction through the detection area;

a first paper moving device, wherein the first paper moving device is operative to move the paper in the paper path on a first side of the detection area;

a second paper moving device, wherein the second paper moving device is operative to move the paper in the paper path on a second side of the detection area;

a detector, wherein the detector detects movement of the paper in the detection area, wherein the detector is operative to sense movement of the paper in a direction generally transverse to the first direction;

a coordinating device operatively coordinating movement of the paper by the first and second paper moving devices, wherein the coordinating device is operative to cause the paper moving in the detection area to selectively move in a direction generally transverse to the first direction;

an electronic circuit in operative connection with the detector, wherein a first signal type is generated responsive to the detector failing to detect movement of the paper in the transverse direction in the detection area.

2. The apparatus according to claim 1 and further comprising a printer device in the paper device, wherein the printer device is operative to print on paper in the paper path.

3. The apparatus according to claim 2 wherein the first paper moving device includes the printer device.

4. The apparatus according to claim 3 wherein the second paper moving device includes a take-up mechanism and wherein the printer is operative to move the paper in the detection area to a first transverse position and the take-up mechanism is operative to move the paper in the detection area to a second transverse position.

5. The apparatus according to claim 4 wherein the paper path includes a supply roll at the first end.

6. The apparatus according to claim 5 wherein the paper path includes a take-up roll at the second end.

7. The apparatus according to claim 6 and further comprising an automated banking machine, wherein the paper path extends in the automated banking machine.

8. The apparatus according to claim 7 wherein the printer device is operative to print indicia on the paper corresponding to transactions conducted with the automated banking machine, whereby the take-up roll provides a paper record of the transactions conducted.

9. The apparatus according to claim 1 and further comprising an automated banking machine, and wherein the paper path extends in the automated banking machine.

10. The apparatus according to claim 9 wherein the printer device prints indicia on the paper corresponding to transactions conducted with the automated banking machine.

11. The apparatus according to claim 1 wherein the paper in the detection area has a generally planar face, and wherein the transverse direction is generally perpendicular to the planar face.

12. The apparatus according to claim 11 wherein the detection area comprises a gap bounded by a pair of disposed guide surfaces, wherein the paper moves transversely in the gap between first and second positions each adjacent one of the disposed guide surfaces.

13. The apparatus according to claim 1 wherein the paper moves transversely between first and second positions in the detection area, wherein the paper moves between the first and second positions each time the paper moves in the first direction generally about a first distance.

14. The apparatus according to claim 13 wherein the electronic circuit is in operative connection with the first paper moving device and wherein the first signal is generated responsive to the first paper moving device operating to move the paper in the first direction a first distance and the detector failing to sense transverse movement of the paper between the first and the second positions.

15. A method comprising the steps of:

moving paper extending in a paper path generally in a first direction with a first paper moving device, the first paper moving device disposed in the paper path on a first side of a detection area, wherein the first paper moving device also causes the paper in the detection area to move in a first transverse direction generally transverse to the first direction;

further moving the paper in the paper path generally in the first direction with a second paper moving device disposed on a second side of the detection area, wherein the second paper moving device also causes the paper in the detection area to move in a direction generally opposed to the first transverse direction;

sensing transverse movement of the paper in the detection area with a detector;

generating a first signal type with an electronic circuit responsive to the detector failing to sense transverse movement of the paper in the detection area.

16. The method according to claim 15 and prior to the first moving step, further comprising the step of printing indicia on the paper in the paper path with a printer device.

17. The method according to claim 16 wherein the paper path extends in an automated banking machine, and prior to the printing step, further comprising the step of conducting a transaction with the automated banking machine, and wherein in the printing step the indicia is representative of the transaction.

* * * * *